US005822938A

United States Patent [19]

Bähr et al.

[11] Patent Number: 5,822,938

[45] Date of Patent: Oct. 20, 1998

[54] STRUCTURAL ELEMENT FOR THERMAL INSULATION

[75] Inventors: Michael Bähr, Jockgrim; Armin Schumacher, Ötigheim; Thomas Edelmann, Ettenheim; Oliver Wagner, Rheinmünster; Claudia Schneider-Liebich, Baden-Baden; Eckart Luz, Rheinmünster; Heike Roth, Sinzheim; Gerhard Trunz, Bühlertal; Andrë Weber, Búhl, all of Germany

[73] Assignee: Schock Bauteile GmbH, Baden-Baden, Germany

[21] Appl. No.: 855,652

[22] Filed: May 15, 1997

[30] Foreign Application Priority Data

May 30, 1996 [DE] Germany ..... 196 21 643.5

[51] Int. Cl.[6] ..... E04B 1/74

[52] U.S. Cl. ..... 52/404.1; 52/404.5; 52/407.5; 52/407.4; 52/424; 52/309.11; 52/310; 52/427

[58] Field of Search ..... 52/424, 425, 426, 52/428, 431, 404.1, 407.4, 407.5, 393, 396.01, 396.04, 167.4, 167.7, 167.9, 309.11, 310, 404.5, 293.3

[56] References Cited

U.S. PATENT DOCUMENTS

| | | | |
|---|---|---|---|
| 5,535,565 | 7/1996 | Majnaric et al. | 52/426 |
| 5,570,552 | 11/1996 | Nehring | 52/426 |
| 5,598,673 | 2/1997 | Atkins | 52/426 X |
| 5,743,056 | 4/1998 | Balla-Goddard et al. | 52/390.11 X |

*Primary Examiner*—Creighton Smith
*Assistant Examiner*—W. Glenn Edwards
*Attorney, Agent, or Firm*—Panitch Schwarze Jacobs & Nadel, P.C.

[57] ABSTRACT

A structural element for thermal insulation between two structural elements to be covered with concrete, especially a building and a projecting external part, has an insulating body to be inserted in between the structual elements and has at least integral compression elements which run transverse to the longitudinal extension of the insulating body and through them and are respectively connected to both structural elements, wherein the compression elements can have of a profile body with several especially vertically running compression bars, and wherein the length of the compression elements in the direction of the longitudinal extension of the insulating body amounts to a multiple of their vertical height.

18 Claims, 2 Drawing Sheets

STRUCTURAL ELEMENT FOR THERMAL INSULATION

BACKGROUND OF THE INVENTION

The invention relates to a structural element for thermal insulation between two construction elements to be covered with concrete, especially between a building and a projecting external part, consisting of an insulating body to be inserted in between with at least integral compression elements which run transverse to the longitudinal extension of the insulating body and through it, and are respectively joined to both structural elements.

With the aid of structural elements of this type, projecting wall elements, for example balconies, are connected with a corresponding intermediate ceiling of a building, while largely ruling out cold bridges. For accommodating compressive forces, the compression elements as a rule have pressure plates at their ends which are anchored in the concrete construction elements and which favor the introduction of force into the compression elements and reduce the anchorage length in the concrete.

Pressure plates of this sort, which are especially constructed in the shape of a disk and which are installed parallel to the longitudinal extension of the insulating body and transverse to the compression elements running through the insulating body, of course have the disadvantage that, owing to them, the central axis of the compression elements cannot be placed at any desired depth in the thermal insulation construction element. First of all, the offset between the central axis of the compression element and the pressure plate underside cannot be reduced to a greater extent while simultaneously maintaining pressure plate function, and second, a certain concrete or insulating body thickness must be maintained below the compression bearing, in order to protect from corrosion the pressure plate and consequently the compression element which is threatened by corrosion. Nonetheless, this prevents what is generally sought, namely to select the greatest distance possible between tension and compressive elements, in order thereby to be able to increase the moment transferred to the compression element.

SUMMARY OF THE INVENTION

It is consequently an object of the present invention to make available a construction element for thermal insulation with a compression element whose geometrical arrangement and configuration makes possible the transfer of greater moments than possible with customary solutions, whereby, however, the thermal insulation properties should not be reduced.

This object is accomplished in accordance with the invention in that the compression elements comprise a profile body with a plurality of especially vertically running compression bars, wherein the length of the compression elements in the direction of the longitudinal extension of the insulating body, thus the length of the installation on the adjacent concrete structural element, amounts to a multiple of their vertical height. While with state of the art compression elements, vertical and horizontal extension are not as a rule differentiated in the juncture plane, as these are constructed rotation-symmetrically, the compression element of the present invention distinguishes itself in that there is only one orientation of the compression element within the thermal insulation element which fulfills the requirements of the compression elements. For the compression element of the invention is, owing to the vertical compression bars running parallel to one another, rigid in the vertical direction and consequently resistant to bending. In contrast, in the horizontal direction, it is constructed to yield to thrust, owing to which it does not impede lateral temperature-conditioned changes in length of the projecting exterior element in relation to the building. In the event that the compression element were improperly installed with a 90° rotation, only a fraction of the compressive forces could be accommodated over a lengthy period of time.

Consequently, the compression element is optimally laid out for the requirements which exist for each of the various directions of stress within the juncture by adapting the dimensions of the compression bars as a function of direction. This leads to a drastic material saving.

On the other hand, providing a plurality of compression bars means that the height of each individual compression bar can be reduced, as the strain to be absorbed can be correspondingly distributed.

The vertical direction of the compression bars indicates that to be sure the entire compression element runs horizontally proceeding from one structural element and therewith transversely to the longitudinal extension of the juncture to the other structural element. Nonetheless, here the compression bars within this horizontally running compression element are at least partially vertically arranged.

The compression bars are appropriately connected through at least one connecting bar running transversely through them, which runs in the direction of the longitudinal extension of the insulating body, either vertically or horizontally, and which gives rise to a mutual fixation of position of the compression bars toward one another. Nonetheless, this mutual fixation of position can also be guaranteed by the insulating body itself, so that a connecting bar would not be necessary and the individual compression bars would be arranged loosely without direct connection. In particular, the profile body comprises at least three compression bars, and the length of the compression elements is at least three times as long as their height, whereby a good relationship between the cross section or the compression element height and the compressive strength or absorbable moment results.

The bars advantageously extend exactly vertically through the insulating body, in order to guarantee the requirements of vertical rigidity and horizontal yield to thrust. With certain configurations of the compression bars, however, inclining them from the vertical can be recommended, which inclination should not exceed 45° in subsections.

For further savings of compression element material, which leads to increasing thermal insulation, providing the compression bars with recesses penetrating them in the insulating body area is recommended.

Above and beyond this, it is advantageous if the compression elements have plate-shaped contact profiles on the sides facing the concrete structural element extending parallel to the longitudinal direction of the insulating body, which at the same time can suitably replace the connecting bar, since they connect the compression bars with one another. Ideally for this purpose, the contact profile surfaces, which serve to absorb the compressive forces, are basically dimensioned as large as the cross sectional area of the compression element circumscribed by the compression bars, so that at least the vertical extension of the compression element is not increased by the contact profiles. By this means, the distance of the contact profile from the lower edge of the insulating body can be minimized and, on account of the larger lever arm between compression and tension elements, the moment which is to be absorbed can be consequently increased. The plate-shaped configuration of the contact profiles also includes in particular rough, ribbed or, quite commonly surfaces provided with projections, which improve the contact with the neighboring concrete structural elements.

In addition to this, the plate-shaped contact profile can hereby be constructed flatter and thus wider, since it is supported on its reverse side by the compression bars, which run at short distances from the vertical to this, and is secured against bending. As a result, with equal force absorption, the contact profile need not have any vertically projecting length in relation to the compression bars which are likewise reduced in their height.

Consequently, it is obvious that the overall height of the compression element including the pressure plates can be diminished through this laminated mode of construction, without this leading to a larger cross sectional area of the compression element material and consequently to a greater heat conductance through the insulating body.

Owing to the laminated construction of the compression elements, it arises that the plate-shaped compression bearing does not have to be constructed larger than the cross sectional area circumscribed by the compression bars, and nonetheless, the bearing surface is constructed greater than the bar cross sectional surface in the insulating body, so that the compression bearing can guarantee its function of introducing compressive forces into the compression element.

For one, it is worth recommending that the contact profiles be connected form-locking with the neighboring concrete structural elements, which can take place through individual projections extending into the concrete, a correspondingly constructed surface, or through a contact profile extending into the concrete structural element. The horizontal thrust movements between the two structural elements are hereby transferred directly to the compression element, which in accordance with the invention is constructed so as to yield to thrust motion. Consequently, relative movements between the concrete structural elements and the compression element, which can lead to an overstressing of the compression bearing surface up to its destruction, are prevented. Second, however, it is also to be recommended that the contact profiles be at least partially embedded in the insulating bodies and only project into the concrete structural element to a small extent, in order thus to keep a sufficient distance from the reinforcement located in the concrete structural element. By means of this, in positioning of the compression elements, the position of the reinforcing elements does not need to be taken into account. Finally, quite commonly, the compression elements, and not merely the contact profiles, can project at least partially beyond the insulating body and be anchored in the adjacent concrete structural element, in order to produce a form lock which especially favors the transfer of horizontal motions.

It is particularly advantageous if the compression elements consist of especially alkali resistant, fiber reinforced plastic, for example glass fiber reinforced thermoplastics or thermosetting plastics, since in this way, a lower heat conductance through the insulating body occurs. Above and beyond this, such a plastic compression element requires no concrete or insulating material cover, as it is not sensitive to corrosion. Rather, the plastic compression element can be set flush with the neighboring concrete structural elements, whereby handling is improved.

In the case of installing a plastic compression element without concrete cover, it is recommended that the compression elements be protected on their underside with a fire protection material, since otherwise, they will rapidly be destroyed in the event of fire, whereupon the entire mounting will have to be remade. A fire protection material of this type is, above and beyond this, also recommended for those exteriors of the insulation body which are not covered by concrete, since the insulation material can thereby be laid out with a view toward thermal and sound insulation, without having to take fire protection characteristics into consideration.

A simplification in equipping the structural element for thermal insulation and a reduction of processing cost results from the fact that the length of the compression element can correspond to the length of the insulation body and consequently, per insulating body, only one compression element with an appropriately large number of compression bars need be made available.

Likewise, the compression elements can be assembled from individual compression bars and/or contact profiles in modular construction fashion, or individual compression elements can be combined into an assembled compression element of variable length. In this connection, the combining can take place through a connecting bar or through suitable connecting means especially through mutual gluing, clipping or locking.

BRIEF DESCRIPTION OF THE SEVERAL VIEWS OF THE DRAWING

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
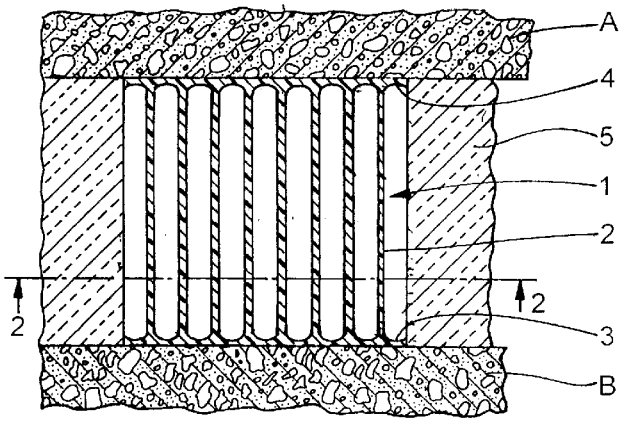
FIG. 1 shows a compression element of the invention in plan view.

In FIG. 1, a compression element 1 is represented in plan view which extends between a building part A and a projecting external part B, for example a concrete slab. The compression element 1 comprises eight vertical compression bars 2 on the end of which, in each case, a plate-shaped contact profile 3 or 4 is arranged extending transversely to the compression bars. In this connection, the contact profile 3 lies flat against the balcony slab B for transfer of the compressive forces, while contact profile 4 is joined flat against the building structural element A. Possible means for anchoring the contact profiles in the concrete structural parts in a form-locking manner (for example in the form of projections) are not represented in the principal drawings for the sake of simplicity.

In addition to the compression element 1, an insulating body 5 is likewise installed in the juncture, between the building structural part A and the balcony slab B which extends the entire length of the juncture and merely has recesses for the tension, shear force and compression elements to be introduced. Thus, the insulating body also extends (as is apparent from FIG. 2) in the juncture above the compression element 1, in order to prevent sound and thermal transfer through the juncture.

Figure 2:
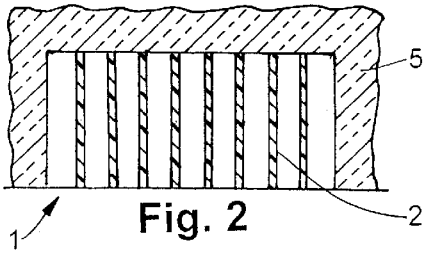
FIG. 2 shows the compression element of FIG. 1 in frontal section taken along the line II—II in FIG. 1.

It can moreover be recognized from the sectional representation of FIG. 2 that the length of the compression element 1 in the direction of the longitudinal extension of the insulating body comes to a multiple of its vertical height, namely double in the present case.

Figure 3:
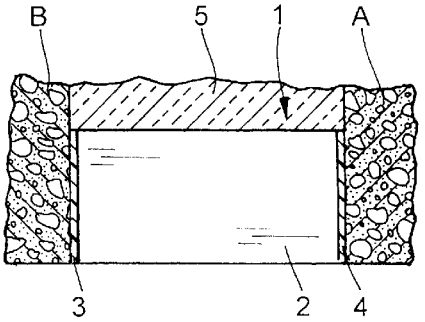
FIG. 3 is a sectional side view of the compression element of FIGS. 1 and 2.

FIG. 3 finally shows the compression element 1 in side (end) view and allows one to see the arrangement of the compression element within the juncture between the two concrete structural elements. Here it is especially apparent that the compression element can be installed in the deepest possible position within the juncture, since in particular the two plate-shaped contact profiles 3 and 4 do not project downward beyond to the compression bars 2. Especially when the compression element 1 is made of plastic, it is also then not subject to any corrosion when it is arranged in the juncture flush with the underside of structural element and consequently exposed to the ambient climate.

With the present embodiment, the contact profiles 3 and 4 lie flush on the two concrete structural elements A and B. These can, however, also be anchored in the in the concrete structural elements by means of projections or extend partially or wholly flat against these concrete structural elements.

Figure 4:
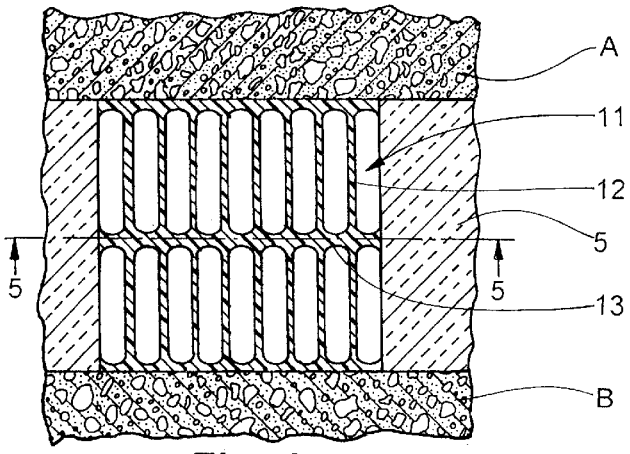
FIGS. 4 to 6 show an alternative embodiment of a compression element in representations corresponding to FIGS. 1 to 3.
Figure 5:
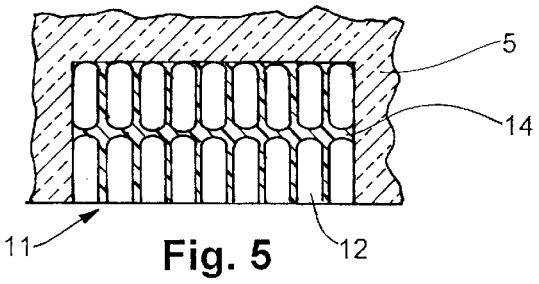
Figure 6:
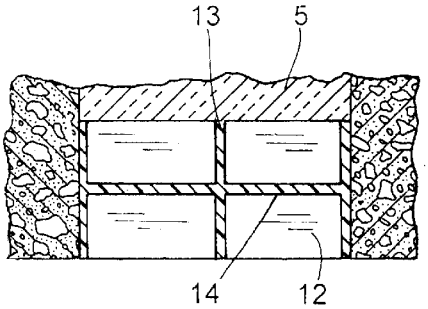

FIGS. 4 to 6 depict a compression element 11 which is constructed similar to compression element 1, which has two additional connection bars 13 and 14 (see FIGS. 4 and 6) which extend perpendicular to the compression bars 12 and are in turn arranged perpendicular to each other. With the aid of these connecting bars 13 and 14, bending resistance and compression strength in particular can be controlled in various directions in a suitable manner.

Figure 7:
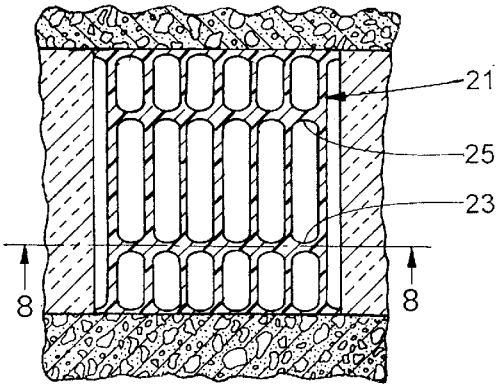
FIGS. 7 to 9 show a further embodiment of a compression element in representations corresponding to FIGS. 1 to 3.
Figure 8:
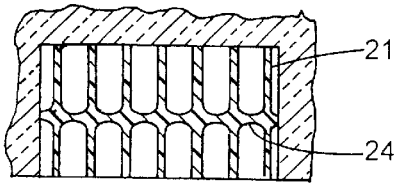
Figure 9:
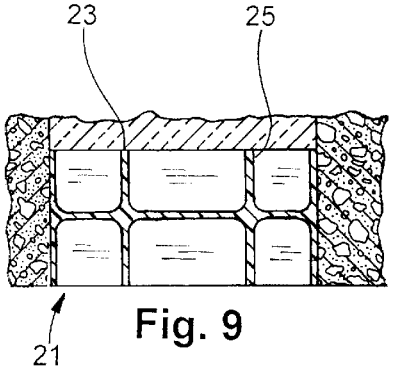

FIGS. 7 to 9 depict in turn a compression element 21 which differs from compression element 11 only in that a further connecting bar 25 is provided parallel to connecting bar 23 (which corresponds to connecting bar 13 from FIG. 4).

Figure 10:
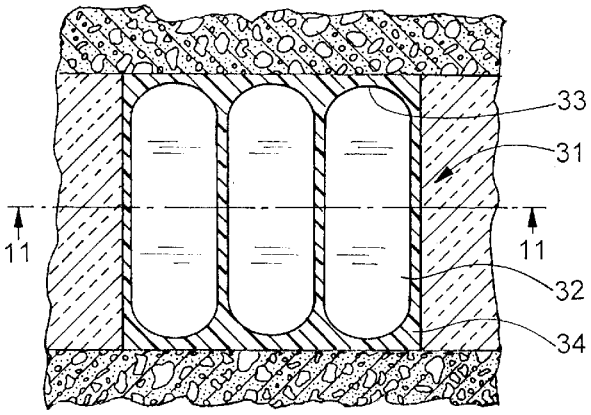
FIGS. 10 to 12 show still a further embodiment of a compression element in representations corresponding to FIGS. 1 to 3.
Figure 11:
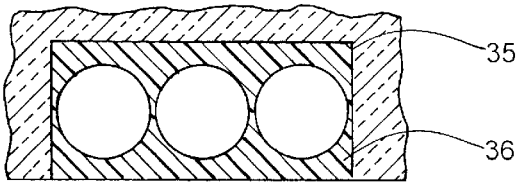
Figure 12:
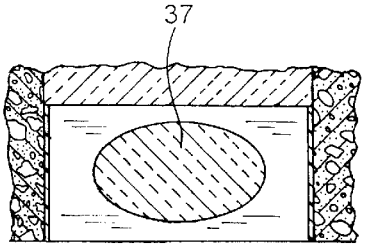

Finally, an embodiment of a compression element 31 is presented in FIGS. 10 to 12. This compression element has, in contrast with the plate-shaped compression bars of compression elements 1, 11 and 21, such compression bars 32 which run arch-shaped at their ends and transition over into the adjacent plate-shaped compression bearings 33, 34 (see FIG. 10) or into the connecting bars 35 or 36 (see FIG. 11). In addition, as can be recognized from FIG. 12, each compression bar 32 is provide d with a recess 37 in order to reduce heat transfer through the compression element.

In order to improve the thermal and sound insulating properties, the intermediate spaces between the individual compression bars can be filled with insulating material in all four embodiments depicted.

In sum, the advantage of the present invention lies in that the compression elements can be positioned in the deepest position possible within the juncture due to their laminated construction, and can even be constructed with but a low height, whereby the moment to be absorbed by the compression element is increased.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A structural element for thermal insulation between two concrete structural parts especially between a building (A) and an projecting external part (B), comprising an insulating body (5) to be inserted in between the two structural parts and includes integrated compression elements which run transversely to and through a longitudinal extension of the insulating body, the compression elements being adapted to be respectively joined to both structural parts, wherein the compression elements (1, 11, 21, 31) comprise a profile body having a plurality of vertically running compression bars (2, 12, 22, 32) and wherein the compression elements have a length in a direction of the longitudinal extension of the insulating body which is a multiple of a vertical height of the compression elements.

2. The structural element according to claim 1, wherein the dimensions of the compression bars (2, 12, 22, 31) are selected to carry stresses in various directions of strain.

3. The structural element according to claim 1, wherein the profile body comprises at least three compression bars (2, 12, 22, 32).

4. The structural element according to claim 1, wherein the length of the compression elements (1, 11, 21, 31) in the direction of the longitudinal extension of the insulating body (5) is at least three times as great as its height.

5. The structural element according to claim 1, wherein at least subsections of the compression bars (2, 12, 22, 32) are inclined at a maximum of 45° from the vertical.

6. The structural element according to claim 1, wherein the compression bars (2, 12, 22, 32) are provided with recesses (37) penetrating them in an area of the insulating body (37).

7. The structural element according to claim 1, wherein the compression elements (1, 11, 21, 31) have plate-shaped contact profiles (3, 4, 33, 34) extending parallel to the longitudinal direction of the insulating body (5) on sides facing the concrete structural parts (A, B).

8. The structural element according to claim 7, wherein the contact profiles (3, 4, 33, 34) are joined with the compression bars (2, 12, 22, 32) running perpendicular to them, and wherein their profile surface is basically dimensioned as large as that of the cross sectional area of the compression element (1, 11, 21, 31) circumscribed by the compression bars.

9. The structural element according to claim 7, wherein the contact profiles (3, 4, 33, 34) are at least partially embedded in the insulating body (5).

10. The structural element according to claim 1, wherein the compression elements (1, 11, 21, 31) project at least partially beyond the insulating body (5).

11. The structural element according to claim 7, wherein the contact profiles (3, 4, 33, 34) are connected by a form locking connection with the neighboring concrete structural parts (A, B).

12. The structural element according to claim 1, wherein the compression elements (1, 11, 21, 31) comprise alkali resistant, fiber reinforced plastic.

13. The sructural element according to claim 12, wherein the compression elements (1, 11, 21, 31) are protected at least on one side with a fire protection material.

14. The structural element according to claim 1, wherein the length of the compression elements (1, 11, 21, 31) in the direction of the longitudinal extension of the insulating body (5) corresponds to a length of the insulating body.

15. The structural element according to claim 1, wherein individual compression bars (2, 12, 22, 32) and/or contact profiles (3, 4, 33, 34) are combinable in modular construction into a compression element (1, 11, 21, 31) variable in length.

16. The structural element according to claim 1, wherein individual compression elements (1, 11, 21, 31) are combinable into a compression element variable in length.

17. The structural element according to claim 15, wherein combining of individual compression bars (2, 12, 22, 32) and/or contact profiles (3, 4, 33, 34) or compression elements (1, 11, 21, 31) takes place through a connecting bar or by connecting means.

18. The structural element according to claim 17, wherein the connecting means is selected from the group consisting of gluing, clipping and mutual anchoring.

* * * * *